United States Patent [19]

Nishimura

[11] Patent Number: 4,691,671

[45] Date of Patent: Sep. 8, 1987

[54] CARBURETOR ICING PREVENTING DEVICE

[75] Inventor: Seiichi Nishimura, Hamamatsu, Japan

[73] Assignee: Sanshin Kogy Kabushiki Kaisha, Japan

[21] Appl. No.: 840,780

[22] Filed: Mar. 18, 1986

[30] Foreign Application Priority Data

Mar. 22, 1985 [JP] Japan ..... 60-55949

[51] Int. Cl.[4] ..... F02B 33/04

[52] U.S. Cl. ..... 123/73 V; 123/52 M; 277/235 B

[58] Field of Search ..... 123/52 M, 73 A, 73 V, 123/52 MF, 52 MC; 277/DIG. 6, 235 B

[56] References Cited

U.S. PATENT DOCUMENTS

| | | | |
|---|---|---|---|
| 3,690,304 | 9/1972 | Schneider et al. | 123/73 A |
| 3,738,336 | 6/1973 | Holland | 123/73 A |
| 4,181,101 | 1/1980 | Yamamoto | 123/73 A |
| 4,244,332 | 1/1981 | Kusche et al. | 123/73 R |
| 4,345,551 | 8/1982 | Bloemers | 123/73 A |

*Primary Examiner*—Craig R. Feinberg
*Assistant Examiner*—David A. Okonsky
*Attorney, Agent, or Firm*—Ernest A. Beutler

[57] ABSTRACT

A carburetor icing preventing arrangement wherein the carburetor, intake manifold and crankcase of a crankcase compression two cycle internal combustion engine are connected to each other by means that promote high heat transfer and which do not include any heat insulating gaskets. A check valve is positioned between the intake manifold and the crankcase and this connection is also highly heat conductive.

6 Claims, 2 Drawing Figures

CARBURETOR ICING PREVENTING DEVICE

BACKGROUND OF THE INVENTION

This invention relates to a carburetor icing preventing device and more particularly to an improved arrangement for heating the carburetor of an internal combustion engine.

As is well known, the function of a carburetor is to vaporize fuel and mix it with air for delivering a stoichiometric fuel/air charge to the engine combustion chambers. When most types of liquid fuel are employed, the vaporization of the fuel tends to cool the intake charge. If the engine and carburetor itself are operting at a low temperature, the heat of vaporization can very well cause sufficient cooling so as to promote icing in the carburetor, an obviously undesirable condition. To avoid this, various devices have been incorporated for heating the carburetor, particularly during cold starting and cold warm-up. The type of devices proposed for this purpose include water heating jackets, electrical heaters and other similar devices. Such heating devices not only add to the cost of the engine, they tend to complicate it and give rise to areas where servicing and maintenance may be required.

It is, therefore, a principal object of this invention to provide an improved and simplified arrangement for preventing carburetor icing.

It is another object of this invention to provide a low cost, simplified and maintenance free carburetor heating device.

SUMMARY OF THE INVENTION

This invention is adapted to be embodied in an internal combustion engine that has a body that defines, in part, a variable volume chamber in which combustion occurs. An induction passage is formed in the body for delivering a charge to the chamber. An intake manifold is affixed to the body and is constructed from a highly heat conductive material and which defines a passage that communicates with the body induction passage. A highly heat conductive gasket is sealingly engaged between the body and the intake manifold for providing heat transfer therebetween. A charge forming device is affixed to the intake manifold for delivering a fuel/air charge to the manifold.

DETAILED DESCRIPTION OF THE PREFERRED EMBODIMENT

Figure 1:
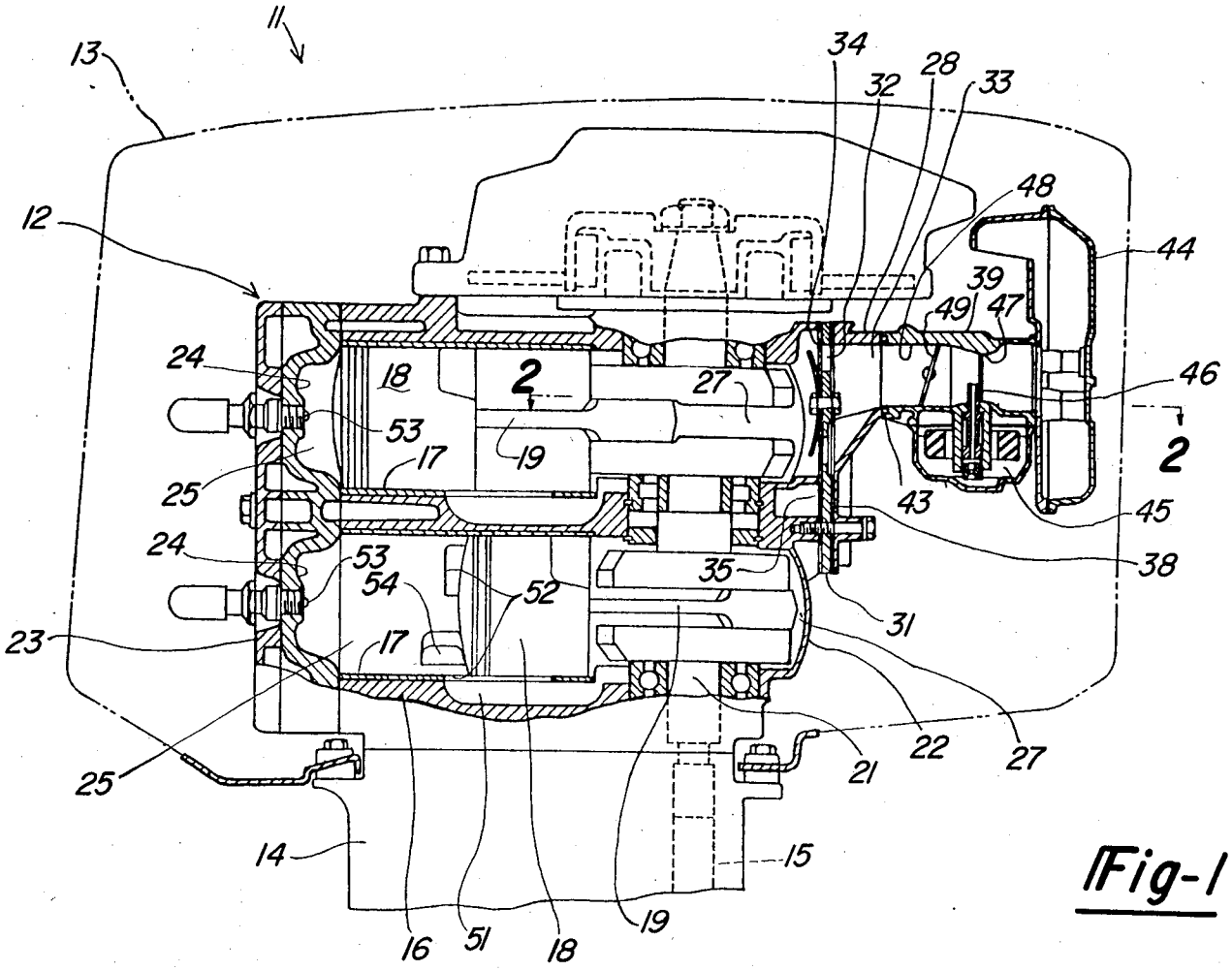
FIG. 1 is a side elevational view of a portion of an outboard motor constructed in accordance with an embodiment of the invention, with portions shown in phantom and other portions shown in cross-section.

An outboard motor constructed in accordance with an embodiment of the invention is identified generally by the reference numeral 11. The invention is directed toward the engine of the outboard motor 11, which engine is identified generally by the reference numeral 12. Because the invention relates to the engine 12 and its induction system, only this portion of the outboard motor 11 has been shown in detail and will be described. It is to be understood, however, that the application of this invention to an outboard motor is exemplary only and the invention may be utilized in conjunction with internal combustion engines having other applications.

The outboard motor 11 includes, in addition to the engine 12, an outer protective cowling 13 which encircles the engine 12 and forms with it the power head of the outboard motor 11. This power head is affixed to a drive shaft housing 14, which is shown in part, and which contains a drive shaft 15 that is driven by the engine output shaft in a manner to be described. The drive shaft 15, in turn, drives the propeller that is contained within a lower unit which is not shown inasmuch as the invention relates to the construction of the engine 12, as has already been noted.

The engine 12 is comprised of a metal cylinder block 16 that is formed with a pair of cylinder bores 17. In the illustrated embodiment, the engine 12 is of the two cylinder inline type and operates on the two-stroke crankcase compression principle. It is to be understood, however, that the invention may be practiced with engines having other types of configurations and also with engines operating on other than the two-stroke principle. However, there are particularly advantages to the use of this system with two-stroke, crankcase compression engines.

Pistons 18 are supported for reciprocation within the cylinder bores 17 and are connected by means of connecting rods 19 to respective throws on a crankshaft 21. The crankshaft 21 is rotatably supported between the cylinder block 16 and a metal crankcase 22 that is affixed in a suitable manner to the cylinder block 16.

A cylinder head assembly, indicated by the reference numeral 23 is affixed to the cylinder block 16 in a known manner. The cylinder head 23 has cavities or recesses 24 which operate with the cylinder bores 17 and pistons 18 to form combustion chambers 25. As is well known, the volume of the combustion chambers 25 varies during each rotation of the crankshaft 21.

The crankshaft 21 rotates about a vertically extending axis and is connected in a suitable manner, as by a splined coupling, to the drive shaft 15 for driving it.

Figure 2:
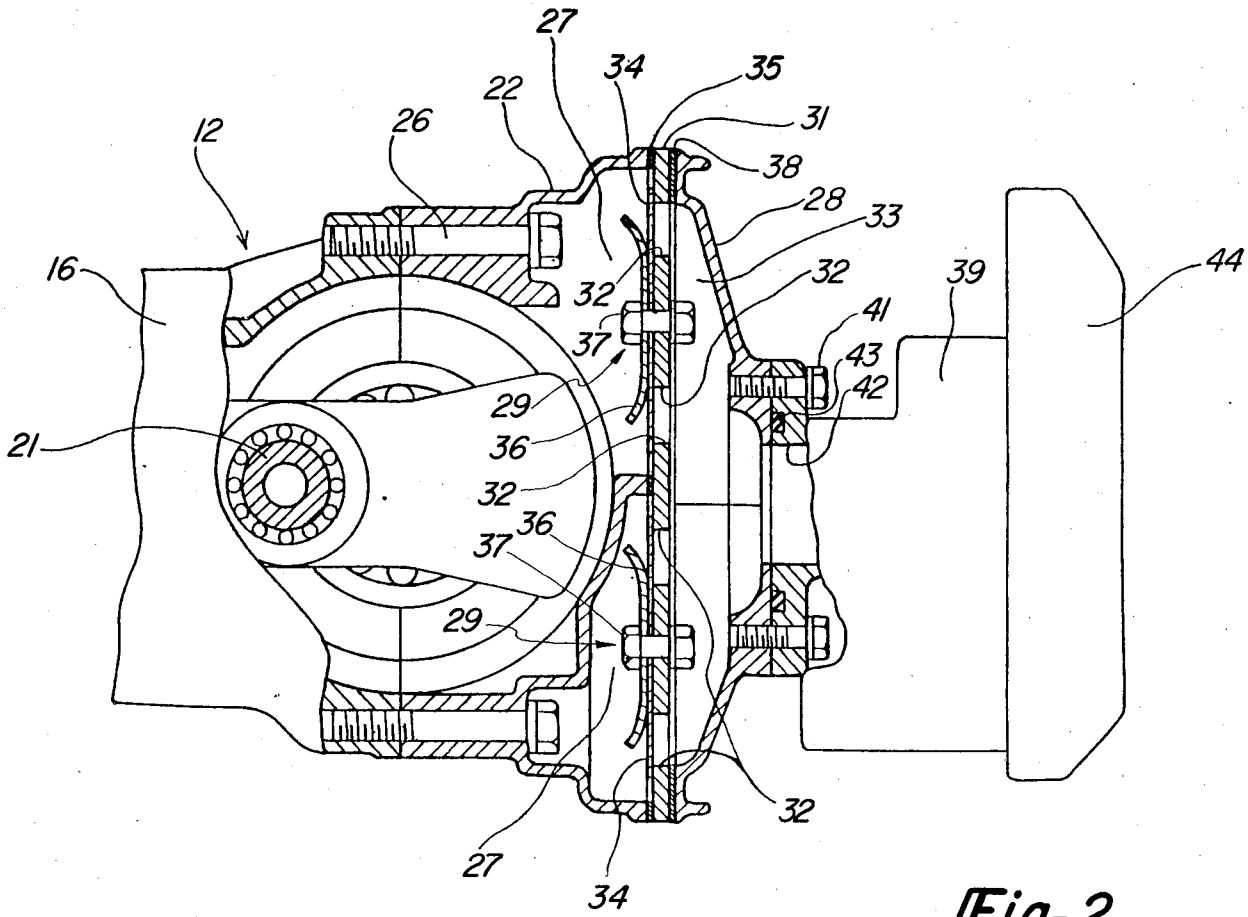
FIG. 2 is an enlarged cross-sectional view taken along the line 2—2 of FIG. 1.

As has been previously noted, the crankcase 22 is connected to the cylinder block 16 in a known manner. As shown in FIG. 2, this connecting means may include bolts 26 and there is no gasket provided between the cylinder block 16 and the crankcase 22 so as to promote heat transfer therebetween, for a reason to be described. However, individual chambers 27 defined within the crankcase 22 and containing the individual throws of the crankshaft 21 are sealed from each other in an appropriate manner because of the crankcase compression of the engine.

An intake manifold, indicated generally by the reference numeral 28, is provided for delivering a charge to the crankcase chambers 27. The intake manifold 28 is formed from a highly heat conductive material, such as a metal like aluminum. In order to prevent backflow from the crankcase chambers 27 into the intake manifold 28 at such time as the pressure in the crankcase chambers 27 exceeds the pressure in the intake manifold 28, there is provided a check valve assembly, indicated generally by the reference numeral 29. The check valve assembly 29 includes a valve plate 31 having a plurality of passages 32 that communicate a manifold passage 33 with the crankcase chambers 27. The flow through the passages 32 is controlled by means of reed type check valves 34 which are formed integrally with a gasket plate 35 that is interposed between the valve plate 31 and the crankcase 22. The gasket plate 35 is formed of a highly heat conductive material such as a metal.

In order to limit the degree of opening of the reed valves 34 and their stress, stopper plates 26 are affixed to the valve plate 31 by means of bolt and nut assemblies 37.

A further sealing gasket 38 is interposed between the valve plate 31 and the manifold 38. The gasket 38 is also formed from a highly conductive material such as a metal like copper.

A carburetor, indicated generally by the reference numeral 39, is affixed to the manifold 28 by means of bolts 41. The carburetor 39 has its mounting flange formed with an annular recess 42 in which an O-ring sealing gasket 43 is provided for sealing the surfaces between the carburetor 39 and the intake manifold 28 without seriously jeopardizing the heat transfer therebetween. An air silencer 44 is affixed to the carburetor 39 for delivering silenced air to it from an internal plenum chamber.

The carburetor 39 is provided with a float bowl 45 in which a constant head of fuel is provided by means of a float operated needle valve. Fuel is discharged from the float bowl 45 through a main discharge nozzle 46 into a venturi throat 47 of the carburetor induction passage 48. A throttle valve 49 is positioned downstream of the nozzle 47 for controlling the air and fuel flow from the carburetor 39 into the intake manifold 28. In addition, the carburetor 38 includes idle and low speed circuits (not shown) which may be of any known type.

The charge delivered to the intake manfiold 28 is distributed to the individual crankcase chambers 27 through the check valve assembly 29. This charge is then compressed in the individual crankcase chambers and is transferred through transfer passages 51 and transfer ports 52 into the combustion chambers 25 for firing by spark plugs 53 in a known manner. The combustion products are exhausted through exhaust ports 54 and an exhaust system (not shown) in a known manner.

The heat generated by the combustion will be transferred to the cylinder block 14 and crankcase 22. This heat will be freely transmitted through the valve plate 31 and highly conductive gasket plates 35 and 38 to the intake manifold 28. The heat is, in turn, transmitted to the carburetor 39 through the connection aforedescribed so that there will be adequate heating of the carburetor 39 under even low temperature running conditions to preclude the likelihood of icing.

In connection with the illustrated embodiment, the application of the invention has been described in conjunction with the induction system for a crankcase compression, two-cycle internal combustion engine. It is to be understood, however, that the same principle may be employed in conjunction with four-cycle engines wherein a highly heat conductive gasket is interposed between the cylinder head and the intake manifold and the intake manifold is in heat exchanging relationship with the body of the carburetor so as to promote carburetor heating. The invention, however, has particular utility with crankcase compression, two-cycle internal combustion engines even though it can also be applied to four-cycle engines.

Although an embodiment of the invention has been illustrated and described, various changes and modifications may be made without departing from the spirit and scope of the invention, as defined by the appended claims.

I claim:

1. An internal combustion engine having a body defining in part a variable volume chamber in which combustion occurs, an induction passage in said body for delivering a charge to said combustion chamber, an intake manifold affixed to said body and constructed from a highly conductive material and defining a passage communicating with said body induction passage, a highly heat conductive gasket sealingly engaged between said body and said intake manifold for promoting heat transfer therebetween, and a charge forming device affixed to said intake manifold for delivering a fuel/air charge to said passage.

2. An internal combustion engine as set forth in claim 1 wherein the carburetor is affixed to the manifold by means of a heat conducting joint.

3. An internal combustion engine as set forth in claim 1 further including a check valve assembly interposed between the intake manifold and the body and comprising a heat conductive valve plate interposed between the gasket and the body and a second heat conductive gasket interposed between the valve plate and the body.

4. An internal combustion engine as set forth in claim 3 further including reed type check valves formed by one of the conductive gaskets.

5. An internal combustion engine as set forth in claim 4 wherein the engine is a crankcase compression two cycle engine.

6. An internal combustion engine as set forth in claim 5 wherein the carburetor is affixed to the manifold by means of a heat conducting joint.

* * * * *